United States Patent [19]

Taniguchi

[11] 4,049,241

[45] Sept. 20, 1977

[54] MOTIONLESS MIXING DEVICE

[75] Inventor: Toru Taniguchi, Tokyo, Japan

[73] Assignee: Reica Kogyo Kabushiki Kaisha, Tokyo, Japan

[21] Appl. No.: 650,547

[22] Filed: Jan. 19, 1976

[30] Foreign Application Priority Data

Jan. 21, 1975 Japan ..... 50-9413

[51] Int. Cl.[2] ..... B01F 15/02

[52] U.S. Cl. ..... 259/4 AC

[58] Field of Search ..... 259/4 A, 4 AB, 4 AC, 259/180, 18, 36; 138/40, 42

[56] References Cited

U.S. PATENT DOCUMENTS

| | | | |
|---|---|---|---|
| 571,196 | 11/1896 | Kirkwood | 138/42 X |
| 1,514,132 | 11/1924 | Cortelyou | 259/4 A X |
| 2,075,867 | 4/1937 | Sampel | 259/4 A X |
| 3,733,057 | 5/1973 | Kahoun | 259/4 A |

FOREIGN PATENT DOCUMENTS

| | | | |
|---|---|---|---|
| 1,807,922 | 6/1969 | Germany | 259/4 AC |

*Primary Examiner*—Robert W. Jenkins

*Attorney, Agent, or Firm*—Spensley, Horn and Lubitz

[57] ABSTRACT

A motionless mixing device for mixing fluidic materials such as liquid, gas, wet and dry powders, etc. employing a generally horizontal cylindrical housing with an inlet at one end and an outlet at the opposite end. A plurality of spaced-apart mixing elements are positioned in the housing to form a mixing device, each of mixing elements being inclined transversely of the longitudinal axis of the housing at a linear edge thereof in the direction of the flow of the fluidic materials flowing through the housing, one end of each said mixing element in the radial direction of the housing being fixedly disposed in the inner wall of the housing, a suitable space being formed between another end of each said mixing element and the adjacent inner wall thereof so that materials trapped by said element are permitted to pass therethrough.

6 Claims, 10 Drawing Figures

MOTIONLESS MIXING DEVICE

BACKGROUND OF THE INVENTION

The present invention relates to an improved motionless mixing device, and more particularly to a mixing device suitable for blending and mixing a plurality of components of fluidic materials flowing through a horizontal cylindrical housing.

In known mechanical mixing device for mixing various fluidic materials such as liquid, gas, wet and dry powders, etc., a mixing device having a moving part has generally been used, which device blends fluidic materials within a mixing tank dynamically.

In order to eliminate disadvantages of such a conventional device, a motionless mixing device has been designed and developed by this applicant, which device is capable of blending and mixing of fluidic materials flowing through a cylindrical housing. It has been disclosed in Japan as a co-pending application of laying-open no. 54959/74. In this conventional mixing device, it is possible to provide highly efficient mixing operation of fluidic materials. This device has been suited for use in many different industries as a compact and economic one. In recent years the mixing device of this type is employed in a wider range such as chemical plant facilities or treatment process of industrial waste fluid.

The foregoing conventional motionless mixing device is more efficient in many applications. However, the mixing device includes a plurality of mixing elements enclosed in a hollow cylindrical housing which comprises a central rod member longitudinally extending in the direction of central axis of the cylindrical housing and a plurality of radial members radially extending around the central rod member. For this reason, there have been disadvantages to easily yield the trapping action of sludge at mixing elements in the vicinity of the central axis of the cylindrical housing and to thereby rapidly fall the flowing rate of fluidic materials during the mixing operation. It has at least been experimentally proved that the trapping action of sludge thereon is caused by the following factors where there are provided small spaces between respective mixing elements in the vicinity of the central axis of the cylindrical housing, whereby a solid in the fluidic materials flowing through the housing being trapped by the small spaces. It is evident that the flowing rate of fluidic materials is rapidly decreased by the solid in the fluidic materials during the short period, since when the motionless mixing device is used for treatment of a sludge stream, the stream includes various solid materials especially waste threads therein.

The present invention has been devised to eliminate the above conventional disadvantages.

Accordingly a principal object of the invention is to provide a new and improved motionless mixing device.

Another object of the invention is to provide an improved motionless mixing device capable of providing efficient mixing action of fluidic materials so as not to yield trapping action of sludge at mixing elements in the cylindrical housing.

To this end, the mixing device according to the present invention includes a plurality of mixing elements fixedly disposed in the inner wall surface of the cylindrical housing, which elements being characterized in that since it does not include the necessity of a central rod member the flow rate of fluidic materials is not decreased by a solid of fluidic stream, a trapping action of sludge at mixing elements being not caused.

The performance characteristics in accordance with the present invention will be apparent from the fact that a plurality of mixing elements include the end surface thereof angularly disposed in the longitudinal direction of the cylindrical housing, there being provided with a space between the other end thereof and the adjacent inner wall of the cylindrical housing.

The invention will now be further described by detailed reference to specific embodiments which are illustrated in the drawings.

DETAILED DESCRIPTION OF THE INVENTION

Figure 1:
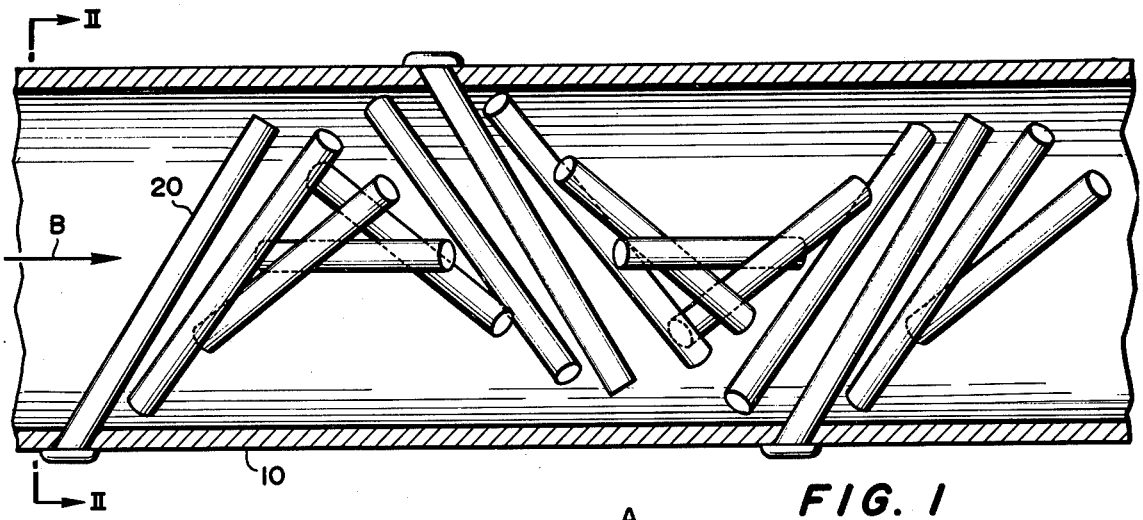
FIG. 1 is a cross-sectional view of a preferred embodiment of motionless mixing device according to this invention.
Figure 2:
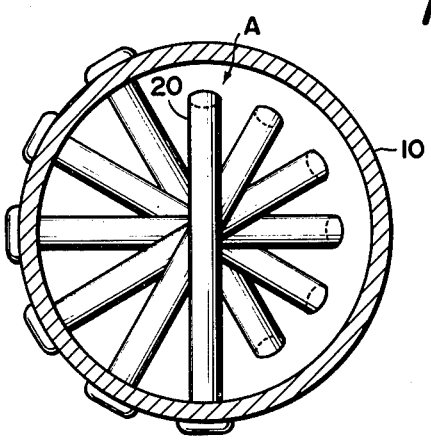
FIG. 2 is a cross-sectional view taken on line II—II of FIG. 1.

FIGS. 1 and 2 are cross-sectional views of preferred embodiments according to the present invention. In FIG. 1, a cylindrical housing 10 communicates at its left side end with a plurality of feeders or ducts (not shown) which supply fluidic materials through a distributing manifold (not shown) whereby one or more fluidic materials to be mixed are supplied into the housing 10. The cylindrical housing 10 communicates at its right side end with a suction pump or similar decompression device which is used for transport of the supplied fluidic materials. On the other hand, it will be often found that fluidic materials are fed into the housing by using a compression device.

In the inner wall of the housing 10 are disposed a plurality of mixing elements 20 which include many rod-like members circular in cross-section, each of said members being at its one end fixedly disposed in the inner wall of the housing 10 by way of this embodiment. As shown in FIG. 2, respective rod-like members are extended transversely of the longitudinal axis of the housing 10, the other free end thereof being not engaged the adjacent inner wall of the housing to define a suitable space A. As best seen in FIG. 1, the rod-like members are fixedly tapered in the inner wall in the direction of longitudinal axis of the housing 10, the above members tapering in the direction of material flow B. A plurality of rod-like members are regularly spaced with one another and disposed in the inner wall of the housing to integrally form mixing elements 20 helical in configuration as shown in the drawing. The housing 10 and the mixing elements 20 are fabricated by selecting any suitable materials such as vinyl chloride, plastic resin, or steel.

The motionless mixing device according to this invention is made of above construction. A plurality of fluidic materials introduced into the housing 10 are blended and mixed efficiently resulting from repeat of subdividing and recombining action of fluidic materials by means of one or more mixing elements 20 which are helically disposed in the housing during transport process thereof flowing through the housing.

A plurality of mixing elements 20 often trap a solid of fluidic materials. However, in this embodiment mixing elements 20 only include straight rod-like members extending angularly from the inner wall of the housing 10, wherein since there are no engaging portions between rod-like members or a central rod member and other support members a solid of fluidic materials is not caught by the above engaging portions when reaching the mixing rod member.

In addition, respective rod-like members which constitute mixing elements 20 are angularly disposed in the inner wall of the housing 10. For this reason, solid materials trapped by the surface of rod-like members are in turn moved along the rod-like members in the direction of material flow. Then solid materials moved to the end of rod-like member are permitted to escape from the member through a space A whereby solid materials are caused to flow through the housing. The motionless mixing device according to this invention includes various advantages in which solid materials are not trapped and caught by the mixing elements in the housing and the device is available for a long period use.

Figure 3:
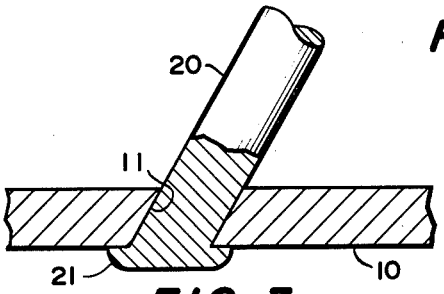
FIGS. 3, 4, 5 and 6 are enlarged cross-sectional views of alternate embodiments illustrating fixedly connected portion between a cylindrical housing and a mixing element, respectively.
Figure 4:
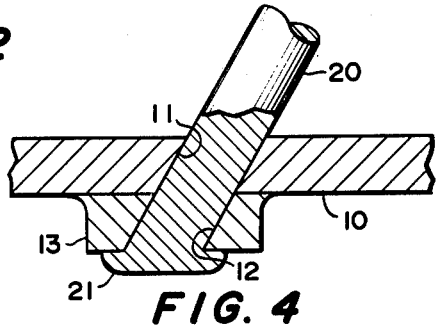
Figure 5:
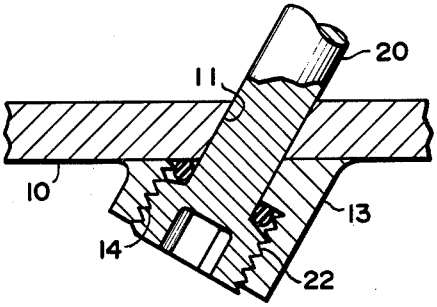
Figure 6:
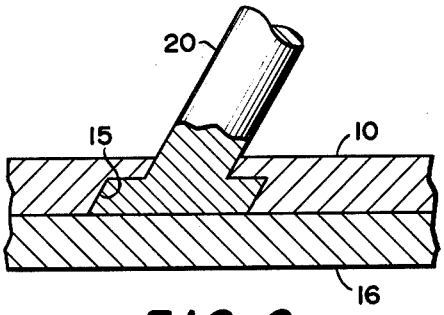

There will be described below alternate embodiments according to the invention concerning a fixedly connected portion between the mixing element and the inner wall of the housing. In FIG. 3, on the cylindrical wall of the housing 10 is provided an opening 11 through which a rod-like member is inserted from the outer wall of the housing 10. The end portion 21 of the rod-like member is fixedly connected by any suitable means such as by welding to the outer wall of the housing 10. FIG. 4 is similar to FIG. 3. On the outer wall of the housing 10 is fixedly connected by welding a support ring 13 having an opening 12 corresponding to the opening 11, to thereby improve the mechanical supporting accuracy of the rod-like member 20. As shown in FIG. 5, the inner surface of the support ring 13 is provided with a threaded portion 14 which is engaged a threaded portion 22 formed on one end of the rod-like member 20 so that the rod-like member 20 is fixedly connected to the housing 10. As seen in the embodiment of FIG. 5, the rod-like member 20 is hermetically sealed to the housing 10 by a O-ring 30. In FIG. 6, the housing 10 defines a plurality of double stage openings 15 on its cylindrical wall, while a plurality of rod-like members 20 employing the end configuration fitting for the double stage openings 15 are enclosed and positioned within the cylindrical wall of the housing 10. When a plurality of entire rod-like members are inserted into the housing, an outer coating tube 16 is to be mounted on the outer wall of the housing 10. According to this embodiment, it is found that the assembling of device was not especially difficult since it is not necessary that a liquid tight connection be made between the rod-like members 20 and the housing 10.

In the foregoing preferred embodiment, the mixing elements are described by using the rod-like member circular in cross-section, which cross-sectional configuration may preferably be semicircular or square in shape.

Figure 7:
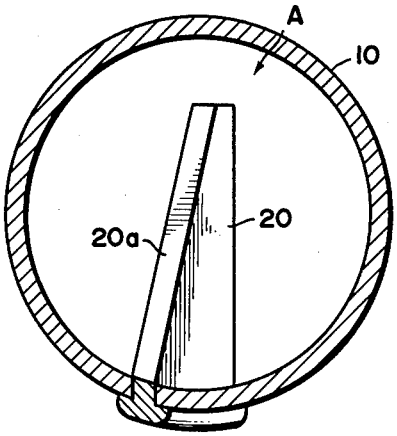
FIG. 7 is a cross-sectional view of another embodiment according to this invention.
Figure 8:
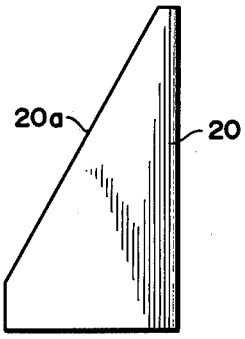
FIG. 8 is a front view of a mixing element of FIG. 7.

There is illustrated another embodiment according to the present invention in FIG. 7, wherein the mixing elements 20 are right-angled triangular in configuration. As best shown in FIG. 8, a mixing element 20 defines an inclined linear edge **20*a* thereon, which element 20 being positioned so that the inclined linear edge 20*a* of this element is [opposite to] in the direction of the flow of the fluidic materials flowing through the housing 10** when the element is fixedly disposed in the inner wall of the housing.

Figure 9:
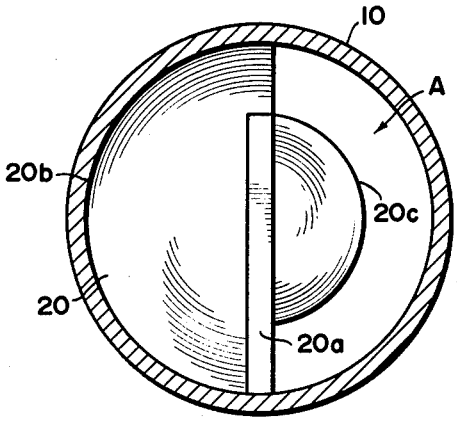
FIG. 9 is a cross-sectional view of still another embodiment according to the invention.
Figure 10:
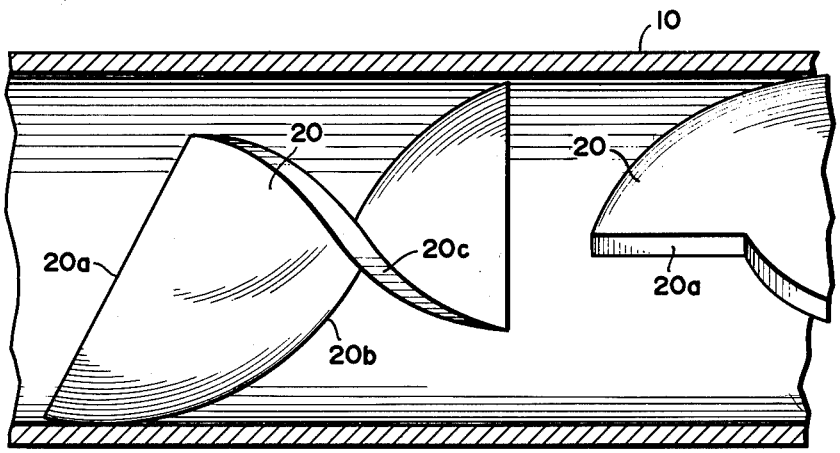
FIG. 10 is a side cross-sectional view of FIG. 9.

In FIGS. 9 and 10, there is depicted alternate preferred embodiment, wherein a motionless mixing element 20 is entered and positioned within the inner wall of the housing 10. This mixing element is formed of a vane in which a plate-like member is twisted at an angle of about 180° in the rotating direction. As shown in FIG. 9, one end of twisted side portion **20*b* of mixing element is entered into the inner wall of the housing 10 and fixedly mounted thereon. Another end of twisted side portion 20*c* of mixing element is formed by shifting the longitudinal twisting center line thereof against the center line of the plate-like member, to thereby producing a space between another end of mixing element and the adjacent inner wall of the housing 10. The end portion of the mixing element opposite to the fluidic materials flowing through the housing 10 defines an inclined linear edge 20*a* thereof. A plurality of mixing elements 20 are spaced in parallel in the direction of the longitudinal axis. At that time respective inclined linear edges 20*a*** are deviated with a predetermined angle. Such angular deviation in this embodiment is about 90°.

As is apparent from the foregoing description, certain changes may be made in the above construction without departing from the spirt and scope of the invention.

I claim:

1. A motionless mixing device, comprising a hollow cylindrical housing for introducing a plurality of fluidic materials and a plurality of mixing elements of circular cross-section fixedly positioned within the housing, each of said mixing elements being inclined transversely of the longitudinal axis of the housing at a linear edge thereof in the direction of the flow of fluidic materials through the housing, one end of each of said mixing element in the radial direction of the housing being fixedly disposed in the inner wall of the housing and extending across and through the longitudinal axis of said cylindrical housing, said mixing element further having a space formed between another end of each said mixing element and the adjacent inner wall thereof so that the materials trapped by said element are permitted to pass therethrough.

2. A motionless mixing device as claimed in claim 1, wherein an outer coating tube is mounted on the outer wall of the housing in order to provide a liquid tight connection between the housing and the mixing elements.

3. A motionless mixing device according to claim 2 wherein said mixing elements are positioned within said housing in a helical pattern.

4. A motionless mixing device, comprising a hollow cylindrical housing for introducing a plurality of fluidic materials and a plurality of substantially triangular in configuration mixing elements fixedly positioned within the housing, each of the mixing elements being inclined transversely of the longitudinal axis of the housing in the directional flow of the fluidic materials through the housing, each mixing element having an inclined linear edge which is inclined in the direction of the flow of fluidic materials through the housing, one end of each of said mixing elements in the radial direction of the housing being fixedly disposed in the inner wall of the housing and extending across and through the longitudinal axis of said cylindrical housing, said mixing element further having a space provided between the other end of each of said mixing elements and the adjacent inner wall thereof so the materials trapped by said element are permitted to pass therethrough.

5. A motionless mixing device as in claim 4 wherein an outer coating tube is mounted on the outer wall of the housing in order to provide a liquid tight connection between the housing and the mixing elements.

6. A motionless mixing device according to claim 5 wherein said mixing elements are positioned within said housing in a helical pattern.

* * * * *